United States Patent [19]

Riedmaier

[11] Patent Number: 5,058,443

[45] Date of Patent: Oct. 22, 1991

[54] PROCESS FOR TESTING OPERATIONAL COMPONENTS IN HEATERS AND TESTING DEVICE FOR THIS PURPOSE

[75] Inventor: Josef Riedmaier, Pentenried, Fed. Rep. of Germany

[73] Assignee: Webasto AG Fahrzeugtechnik, Fed. Rep. of Germany

[21] Appl. No.: 276,523

[22] Filed: Nov. 28, 1988

[30] Foreign Application Priority Data

Dec. 10, 1987 [DE] Fed. Rep. of Germany ..... 3741901

[51] Int. Cl.[5] ..... G01M 19/00

[52] U.S. Cl. ..... 73/865.9; 73/118.1; 324/384

[58] Field of Search ..... 73/865.9, 118.1; 431/13; 432/32; 364/551.01; 324/384

[56] References Cited

U.S. PATENT DOCUMENTS

| | | | |
|---|---|---|---|
| 3,236,284 | 2/1966 | Kemper | 431/13 |
| 3,771,321 | 11/1973 | Maksy | 73/865.9 X |
| 3,945,255 | 3/1976 | Bisgaard et al. | 73/865.9 |
| 4,002,973 | 1/1977 | Wiesendanger et al. | 73/865.9 X |
| 4,062,241 | 12/1977 | Eberle | 73/865.9 |
| 4,176,651 | 12/1979 | Backus | 431/80 X |
| 4,392,810 | 7/1983 | Bears et al. | 431/11 X |
| 4,432,232 | 2/1984 | Brantley et al. | 73/865.9 |
| 4,718,602 | 1/1988 | Beck et al. | 237/32 |
| 4,765,193 | 8/1988 | Holden et al. | 73/865.9 |

FOREIGN PATENT DOCUMENTS

| | | | |
|---|---|---|---|
| 3233018 | 6/1983 | Fed. Rep. of Germany | 73/118.1 |
| 3233031 | 6/1983 | Fed. Rep. of Germany | 73/118.1 |
| 3324100 | 1/1985 | Fed. Rep. of Germany | 73/865.9 |

*Primary Examiner*—Tom Noland

*Attorney, Agent, or Firm*—Sixbey, Friedman, Leedom & Ferguson

[57] ABSTRACT

A process for testing operational components in heaters, especially vehicle auxiliary heaters, in which the operational components are actuated and switched on sequentially, individually. Based on this, a corresponding evaluation is then performed. Further, a testing device for performing the process has a switching-on device with which the operational components can be started up, individually, on a sequential basis. From the process engineering viewpoint and from the device engineering viewpoint, further developments up to integration of the testing device in a heater control device are possible, and, optionally, for evaluation of the operational testing, external devices can also be used.

24 Claims, 6 Drawing Sheets

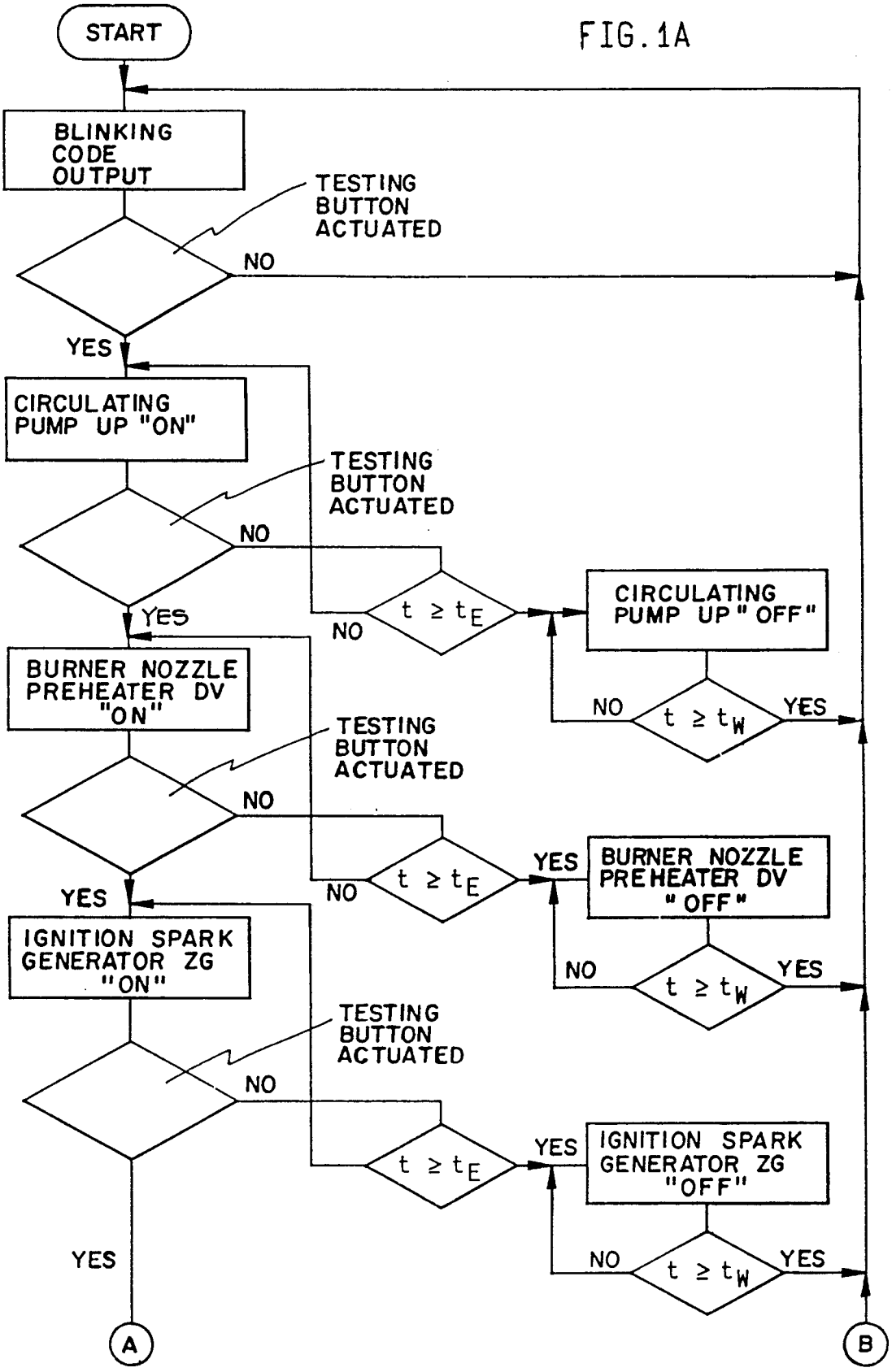
FIG. 1A
START
BLINKING CODE OUTPUT
TESTING BUTTON ACTUATED
NO
YES
CIRCULATING PUMP UP "ON"
TESTING BUTTON ACTUATED
NO
YES
NO
t ≥ tE
CIRCULATING PUMP UP "OFF"
NO
t ≥ tW
YES
BURNER NOZZLE PREHEATER DV "ON"
TESTING BUTTON ACTUATED
NO
YES
NO
t ≥ tE
YES
BURNER NOZZLE PREHEATER DV "OFF"
NO
t ≥ tW
YES
IGNITION SPARK GENERATOR ZG "ON"
TESTING BUTTON ACTUATED
NO
t ≥ tE
YES
IGNITION SPARK GENERATOR ZG "OFF"
NO
t ≥ tW
YES
YES
A
B

PROCESS FOR TESTING OPERATIONAL COMPONENTS IN HEATERS AND TESTING DEVICE FOR THIS PURPOSE

BACKGROUND OF THE INVENTION

The invention relates to a process for testing operational components of heaters, especially vehicle auxiliary heaters, such as the circulating pump, burner nozzle preheating device ignition spark generator, solenoid valve, burner motor, vehicle blower, and the like. The invention also relates to a testing device for these operational components of such heaters.

Up to now testing of the above-named operational components took place with the help of a special testing device, which was inserted between a control device of the heater and the components to be tested or was connected instead of the control device. Such a method of checking is time-consuming and many manipulations must be performed if the control device of such a heater is not very accessible, as can be the case, especially where the heater is installed in a motor vehicle. Further, by the connecting work for the separate testing device, changes are made with respect to the operating condition of the heater, which may, for example, affect the ability to detect a malfunction condition that has occurred and which is to be eliminated. Also, with such special testing devices it is necessary to match the testing device to the respective type of control device and/or heater to be tested. This means a high development expenditure and correspondingly high costs

SUMMARY OF THE INVENTION

The invention aims, by overcoming the difficulties described above, to provide a process for testing operational components in heaters, especially vehicle heaters, as well as a testing device for this purpose, which allow an operational checking of the individual components in a simplified way, and especially without changing the connections of the control device and heater, or the condition in which they are installed in the vehicle.

According to the invention, a process for testing operational components, such as the circulating pump, burner nozzle preheating device, ignition spark generator, solenoid valve, burner motor, vehicle blower and the like in heaters, especially vehicle heaters with a control device, is distinguished by the fact that the operational components are individually actuated on a sequential basis for operational testing, and on the basis of this actuation, an evaluation is made as to the source of a malfunction.

In the testing process according to the invention, the operational components are individually actuated and switched on sequentially so that a complete failure of the respective switched-on component can easily be determined optically and/or acoustically. Other operational malfunctions, such as line breaks and/or short circuits, can also be quickly and easily determined with the help of this testing process. For example, during sequential turning on of the individual operational components, malfunctions producing a reduced speed or grinding noise of blowers or the like can be detected. If during the sequential actuation for testing purposes a defect is detected, the course of the signal, going from the control device to the actuated or switched-on operational component can be followed, for example, with the help of a multimeter or indicatin light, to detect the cause of the defect. indication light, to detect the cause of the defect. Thus, the entire heater need not be put into operation to test the operational components, so that the testing work can be performed quickly and possible malfunctions can eliminated quickly.

According to a preferred embodiment, actuation for operational testing can be performed by, for example, pressing a button so that, in this way, a manual performance of the testing process according to the invention is possible, which can be produced in a structurally simple way.

Alternatively, actuation for operational testing can also be initiated merely by connecting a testing device, for which purpose a short-circuiting bridge can be used.

Suitably, the defects that appear during actuation of the operational components can be evaluated and displayed, for which purpose, for example, light-emitting diodes or the like can be used. The evaluation and/or indication can also be computeraided.

It has proved especially suitable for the outcome of the testing process to provide an indication of operational readiness for commencing the testing of the operational components. For this purpose, for example, a blinking code output can be produced, such as by a flashing light emitting diode.

A suitable further development of the invention is that the cycle for testing the operational components may be performed automatically. That is, the control device for the heater additionally has a type of operation for testing operational components. In this case, the sequences explained above are run through automatically.

Especially in heaters that have a microprocessor control as the control device, testing of the operational components is performed by the microprocessor, and the microprocessor control can be set so that it performs the evaluation of the testing of the operational components and/or display of the respective testing result.

In accordance with a further advantageous embodiment of the invention, the process further comprises the performance of a self-test of the control device. This self-test is performed before testing the operational components according to the above embodiments, so that operational malfunctions caused by the control device and operational malfunctions caused by the operational components of the heater can be distinguished from one another.

According to another aspect of the invention, a testing device for operational components of a heater, such as the circulating pump, burner nozzle preheating device, ignition spark coil, solenoid valve, burner motor, vehicle blower and the like, especially of a vehicle heater with a control device, is provided, and which includes a switching-on device for sequential, individual startup of the operational components.

Such a testing device according to the invention allows the separate startup of the individual operational components in sequence for optically or acoustically detecting the existence of a malfunction condition. Such a testing device can be of a structurally simple design and can, especially, be used universally for different control device types and/or heater types, since the testing device can work together with the control device, so that the connections of the heater and control device need not be changed. By this means, reliable operational testing is also possible, since interference defects caused by the line connections can also be detected.

A suitable configuration of the testing device according to the invention is distinguished by the fact that the switching-on device for testing the operational components can be actuated manually. For this purpose, an actuation button, for example, can be provided. Such a configuration of a testing device can be achieved, for example, on a testing device without significant added expense.

According to an alternative embodiment, an automatic operation of the switching-on device is provided. For this purpose, it can be suitable to integrate the switching-on device into the control device of the heater by providing corresponding test circuits in the control device. In such a design, in the control device, an evaluation device can be provided, which works with the switching-on device and which, optionally, also works with a display device to display the corresponding causes of malfunction.

Alternatively, the evaluation and display device can be external to the testing device, and a connection can be made, for example, with a computer by data transmission means.

Especially, the operational readiness of the testing device can be easily recognized if a blinking code output device is provided, which is actuated if a test of the operational components of the heater is to be made or if the testing procedure with the help of the testing device has been concluded.

Suitably, the test device includes an evaluation and a display device for malfunctions occurring during the respective switching-on cycle, for which purpose light-emitting diodes or the like can be provided. By corresponding codings, individual malfunctions can be easily identified with the help of the testing device so that the cause of the malfunction can be quickly eliminated. In this way, maintenance work in cases of malfunction of such a heater is simplified.

To differentiate the causes of malfunctions caused by the control device from those that are attributable to the operational components, a self-testing device is, advantageously, assigned to the control device, and the testing device according to the invention is then designed so that the switching-on device for testing the operational components of the heater can be actuated only after the self-testing device for the control device has confirmed that the control device is not malfunctioning.

The testing device according to the invention can be designed, as a whole, as a microprocessor device, and such a microprocessor device can also be part of a microprocessor control of a control device for such a heater. In this case, the testing device is then integrated directly into the microprocessor control device.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIGS. 1A and 1B are respective portions of a flowchart representing the sequence of the process for testing operational components of a heater in accordance with a preferred embodiment of the invention;

DETAILED DESCRIPTION OF THE PREFERRED EMBODIMENTS

Figure 1B:
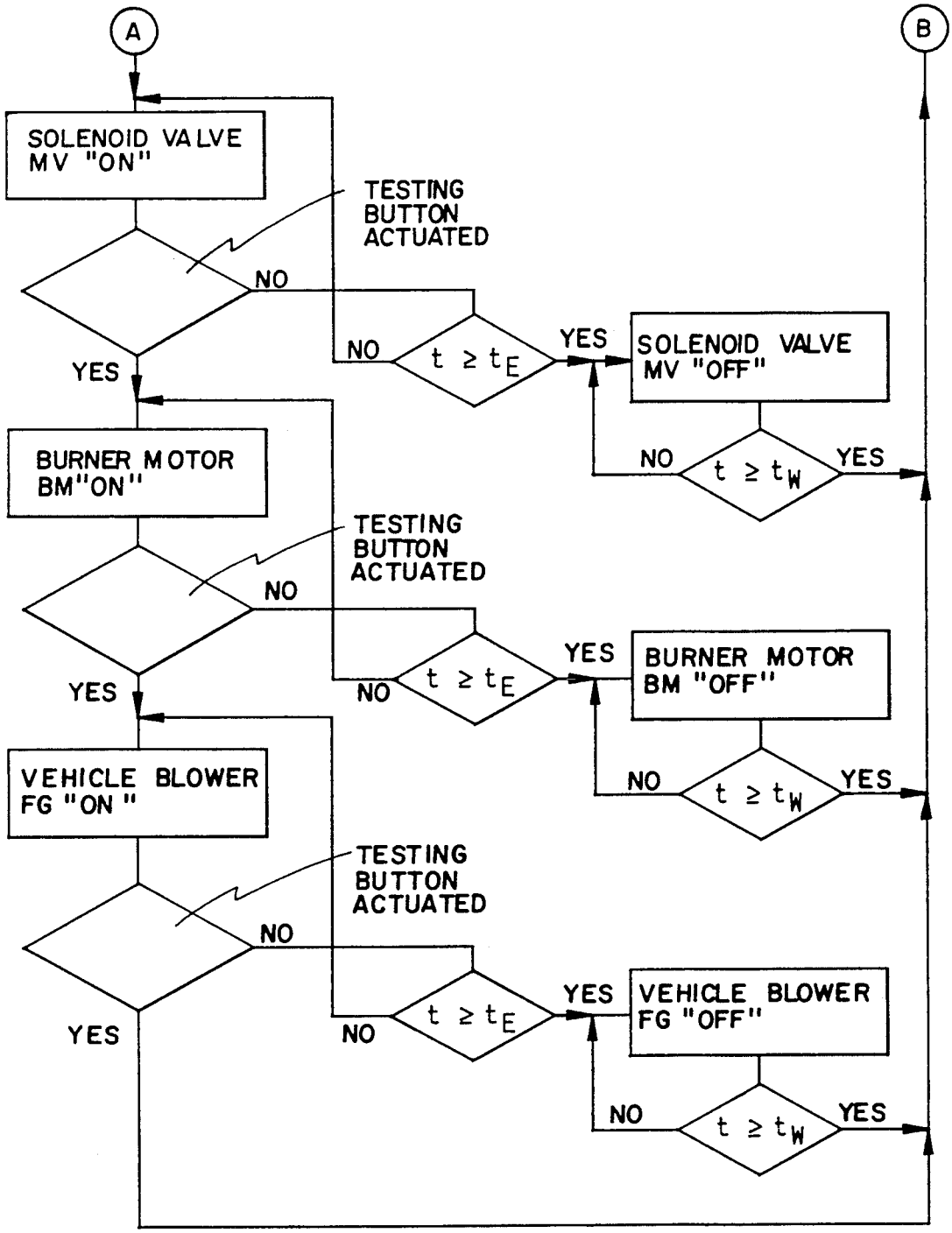

With reference to FIGS. 1A and 1B, an example of a process sequence for testing operational components of, for example, an auxiliary vehicle heating device will be explained. Here, FIG. 1B represents a continuation of the flowchart of FIG. 1A, at interfaces designated by the circled letters A and B.

After the start of the process sequence, designated by "start", a blinking code output indicates readiness for performing testing of the individual operational components. When a testing device is connected, it is checked in a next step as to whether or not the testing button of the testing device is actuated. If the testing button is not actuated, the process sequence returns to the blinking code output. If, on the other hand, the testing button is actuated, in the embodiment represented, circulating pump UP is switched on as an operational component of the heater. If the testing button of the testing device is not actuated again, circulating pump UP remains switched on for a predetermined switched-on period $t_O$ for operational testing. If this switched-on period $t_O$ is over or is exceeded, circulating pump UP is turned off. If, within a predetermined waiting period $t_W$, no further actuation of the testing button of the testing device occurs, then the process sequence again returns to the blinking code output.

If, after switching off circulating pump UP, the testing button of the testing device is actuated within predetermined waiting period $t_W$, then burner nozzle preheater device DV is switched on as the next operational component to be tested. Here, for example, preheater device DV may be a cartridge type heater that is placed in the burner nozzle of a heater 1. Similar to what was explained above in connection with circulating pump UP, now burner nozzle preheater device DV remains switched on for a predetermined switched-on period $t_O$ in order to carry out operational testing thereof. Next, burner nozzle preheater device DV is switched off and if, within predetermined waiting time $t_W$, no further actuation of the testing button of the testing device occurs, the program sequence returns again to the blinking code output.

If, within waiting time $t_W$, another actuation of the testing button occurs, burner nozzle preheater device DV is switched off after predetermined switched-on period $t_O$, and then ignition spark generator ZG is the next operational component of the heater that is actuated for testing. In a similar way as has been explained above, then operation of ignition spark generator ZG is checked during predetermined switched-on period $t_O$.

If, within waiting time $t_W$ and after switching ignition spark generator ZG off, another actuation of the testing button of the testing device occurs, solenoid valve MV is the next functional component to be switched on. Solenoid valve MV also remains switched on for a predetermined switched-on time $t_O$ and then solenoid valve MV is switched off. If, after switching solenoid valve MV off and before expiration of waiting time $t_W$.

another actuation of the testing button occurs, burner motor BM of the heater is switched on. The burner motor also stays switched on in a corresponding manner for predetermined switched-on time $t_O$ and is then switched off. If, within waiting time $t_W$, another actuation of the testing button occurs, then, after switching burner motor BM off, for example, vehicle blower FG is switched on, as the next operational component to be tested. After a predetermined switched-on time $t_O$, vehicle blower FG is switched off, and the process sequence then, again, returns to the blinking code output indicating that, for the illustrated example, a testing cycle for circulating pump UP, burner nozzle preheater device DV, ignition spark generator ZG, solenoid valve MV, burner motor BM and vehicle blower FG has ended.

Since, in the process sequence explained above, the individual operational components such as circulating pump UP, burner nozzle preheater device DV, ignition spark generator ZG, solenoid valve MV, burner motor BM, and vehicle blower FG are individually switched on sequentially in each case, in a simple embodiment of the process, malfunctions or defects can be observed optically or acoustically by a person performing the test. Starting from the control device of the heater, in case of a defect, the course of the signal can then be followed to the operational component actuated in each case, for which purpose a multimeter or an indication light can be used. In carrying out the process for testing the operational components, no operational function is carried out for the entire heater.

Switched-on period $t_O$, indicated in the flowchart, can be the same for all operational components to be tested or switched-on period $t_O$ can be selected to be different for each of the operational components to be tested. In practice, it has been shown, for example, that a switched-on period $t_O$ of about 15 seconds is sufficient, and this switched-on period $t_O$ is suitably assumed to be the same for all operational components to be tested. The waiting time $t_W$ can, for example, run up to 60 seconds, or a period of 45 seconds, for example, can also be sufficient.

Figure 2:
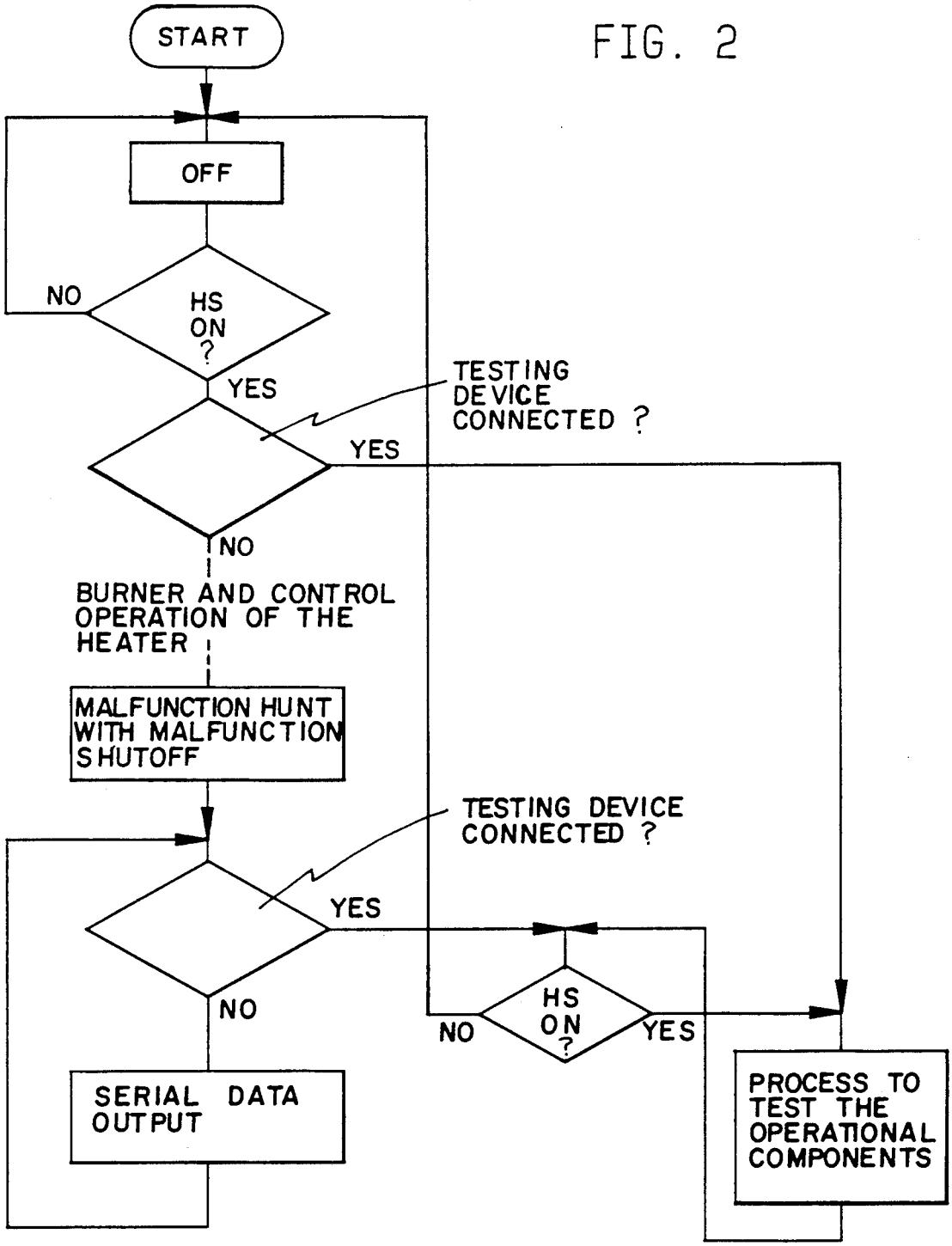
FIG. 2 is a flowchart of a process for testing the control sequence for operation of a heater.

In FIG. 2, a variation of the testing procedure for the operational components of a heater interacting with a heater control device Hs is explained. If heater control device Hs is switched on, then, in the operational mode, a jump to operational component testing, as explained based on FIGS. 1A and 1B, is made by querying with respect to whether or not a testing device is connected, and obtaining a positive result, i.e., one designated "yes" in FIG. 2. If, on the contrary, this query is concluded with the result "no," then the heater is operated under control by heater control device Hs according to the desired work sequence. If a malfunction occurs during operation of the heater, then, for example, a malfunction cutoff occurs by heater control device Hs and the heater then conducts a predetermined malfunction hunt, which is set, for safety reasons, to let individual operational components of the heater continue to work, to avoid critical operating conditions. Here, for example, circulating pump UP or burner motor BM can be involved.

After this malfunction hunt, a query is made as to whether or not a testing device is connected. If a testing device is connected and heater control device Hs is switched on, then the testing process is performed with the testing device.

As indicated in FIG. 2, when no testing device is connected, a serial data output can occur, for example to an external evaluation and display device, so that the operating data of the heater at the time of the malfunction cutoff are secured for an optional external malfunction cutoff diagnosis.

Figure 3:
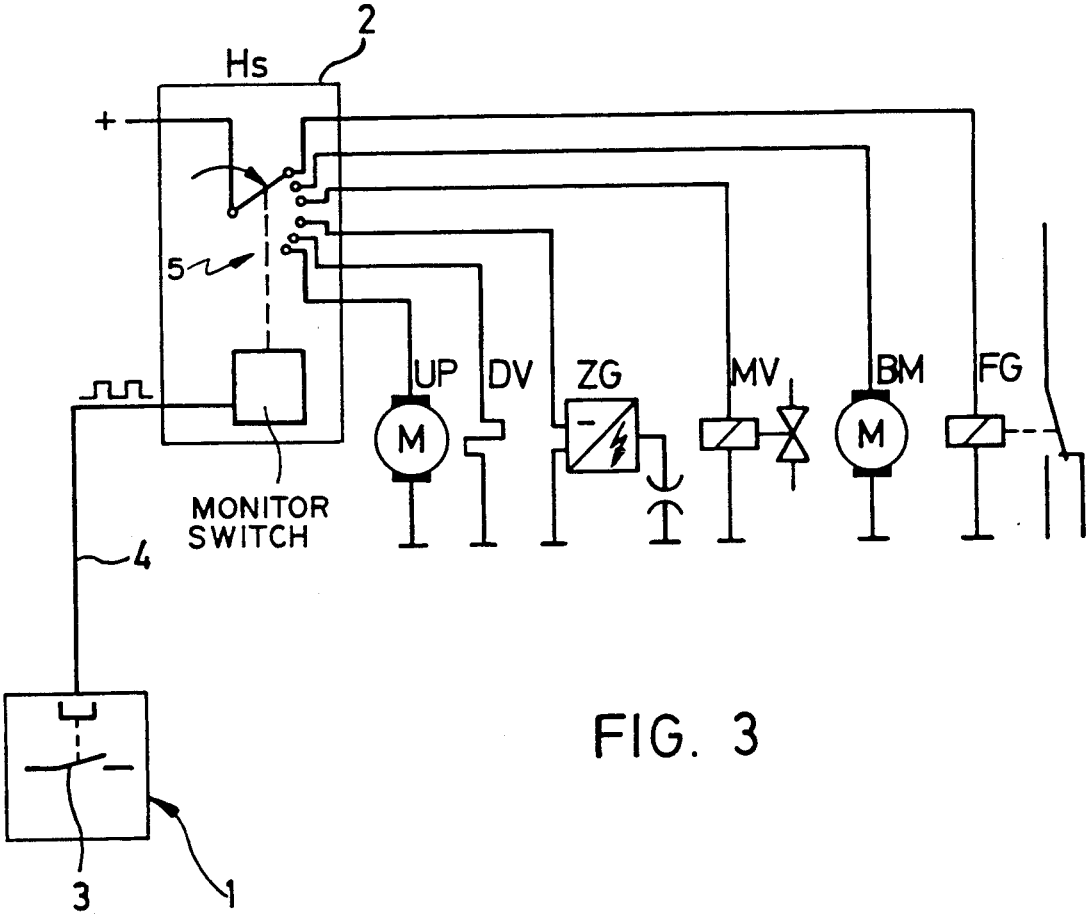
FIG. 3 is a diagrammatic view of a testing device, in accordance with the invention, for implementing the process of FIGS. 1 and 2.

FIG. 3 shows a first embodiment of a testing device according to the invention, designated overall by numeral 1, and numeral 2 designates heater control device Hs, as a whole. Testing device 1 has an actuation button 3 that is connected by a line connection 4 to a corresponding input in heater control device 2. The individual operational components of the heater to be tested (which are only symbolically represented) are shown in FIG. 3 with the designations used in FIGS. 1A, 1B. By pushing actuating button 3 of testing device 1, a control pulse (not labelled) is delivered to heater control device 2, and the latter then individually switches on, by a monitoring switch 5, the operational components to be tested, one after the other, in each case to perform, for example, a process sequence for operational testing as explained based on FIGS. 1A and 1B.

As shown by the FIG. 3 example of a testing device 1, the individual operational components of the heater are switched on and checked, and heater control device Hs stays connected, unchanged. Thus, only testing device 1 must be connected in a suitable way by line connection 4 to heater control device 2.

Figure 4:
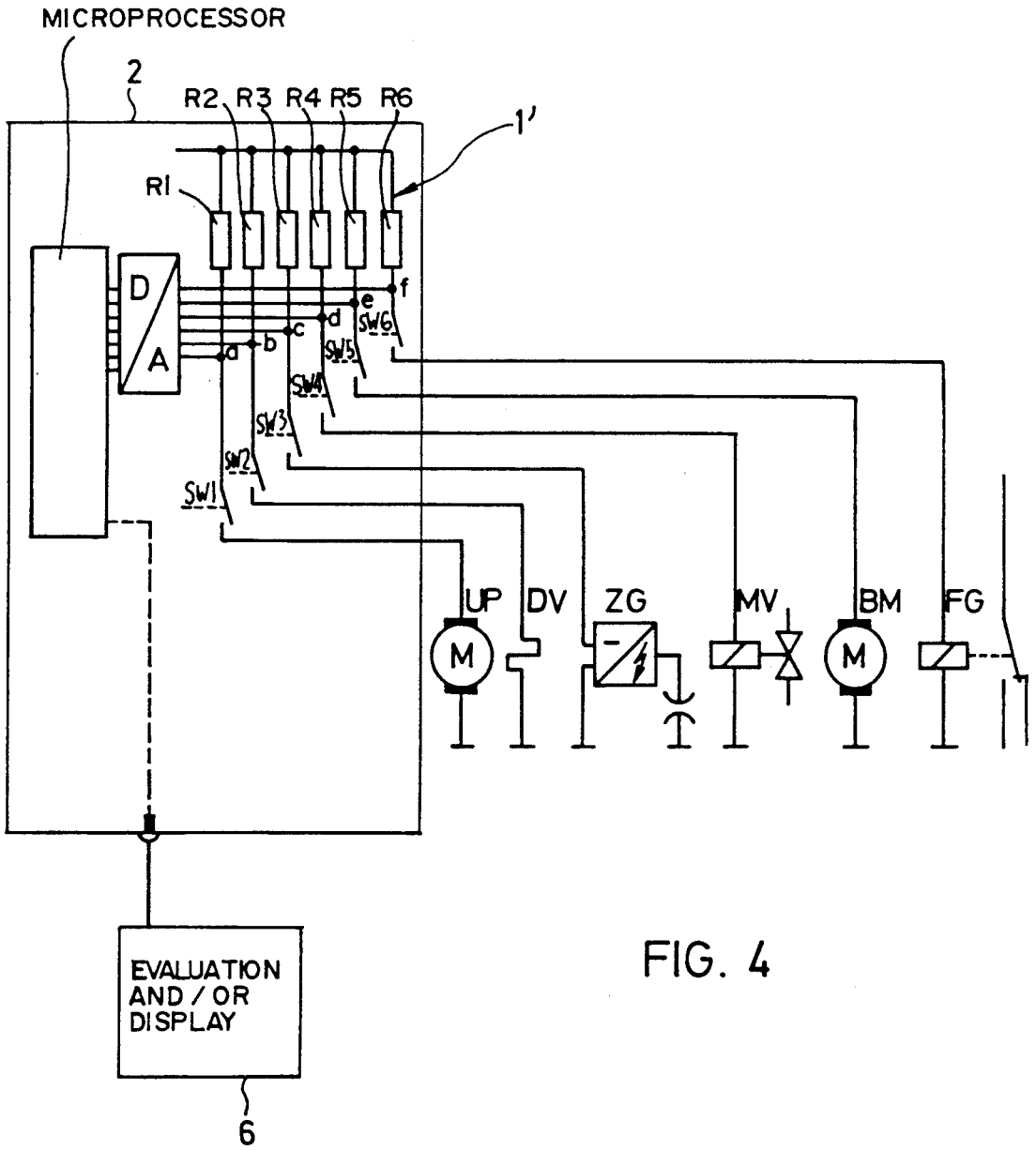
FIG. 4 is a diagrammatic view of a modified embodiment of a testing device with an evaluation device.

FIG. 4 shows a modified embodiment of a testing device 1', in which an embodiment is involved in which the heater control device contains a microprocessor. In this example, testing device 1' is integrated into heater control device 2' and the tests of the individual operational components can occur automatically, sequentially, with the help of testing device 1'. Here, the testing process can run automatically, for example, in response to a malfunction cutoff, or a specialized testing routine for the individual operational components can be conducted by the microprocessor device.

In accordance with a further aspect of testing device 1', heater control device 2' can have an input/output device, which makes possible a connection to an external evaluation and/or display device 6 with whose help, for example, malfunction causes can be detected and/or identified automatically.

In FIG. 4, the individual operational components to be tested are designated by the same reference symbols as in the preceding figures. Each component is connected by a respective switch SW1 to SW6 to a measuring resistor or other resistor, R1–R6. A line runs from the microprocessor, through analog-digital converter D/A to a point between each switch and resistor. Circulating pump UP is connected to resistor R1 through switch SW1 and point a. Preheater device DV is connected to resistor R2 through switch SW2 and point b. Ignition spark generator ZG is connected to resistor R3 through switch SW3 and point c. Solenoid valve MV is connected to resistor R4 through switch SW4 and point d. Burner motor BM is connected to resistor R5 through switch SW5 and point e. Vehicle blower FG is connected to resistor R6 through switch SW6 and point f. The values of the resistors depend on and are chosen to correlate to the unit to be measured or watched by the circuit. The switches may be mechanical, electromagnetic, or any equivalent relay.

In this embodiment, the microprocessor is used as a central processing unit to control the operation of the heating device as well as for the diagnosis of faults which may occur during operation. Thus, this diagnosis system is integrated into the control unit of the heating device. Closing one of switches SW1–SW6, provides, at the respective connection point a-f, an analog signal representing the current value and/or voltage value, corresponding to the operational component to be watched. This analog signal is converted into a digital signal by the converter D/A and then the digital signal is input into the microprocessor device. By using a program stored in the microprocessor device, the digital signals are processed and, dependent upon the results of this processing, evaluation and/or display device 6 is operated through one of the output lines shown by a broken line in FIG. 4. In this embodiment, all the functional parts can be controlled in a parallel relationship in order to survey the operating condition of the functional parts of the heating device. Interruption of the connecting wires as well as any short circuit may be recognized even during the operation of the heating device.

Figure 5:
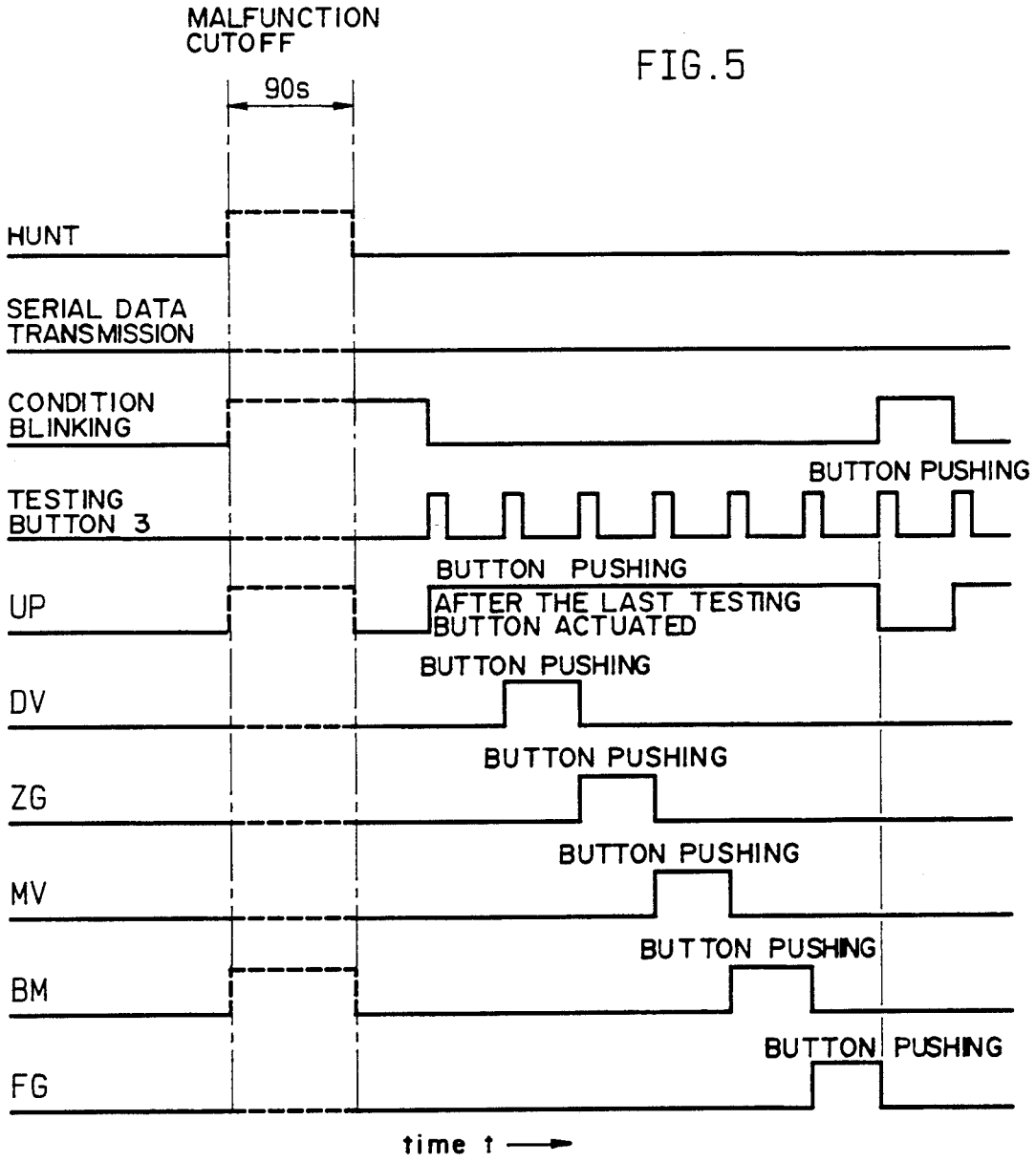
FIG. 5 shows a time sequence diagram for use in explaining a test procedure carried out with the help of the testing device.

With reference to the time sequence diagram of FIG. 5, a test sequence is explained as an example as a testing process that can be conducted with the aid of either of the testing devices 1, 1'.

Dashed lines in FIG. 5 indicate the case in which testing of the operational components is performed after a malfunction cutoff of the heater. As an example, for the duration of the malfunction hunt (see FIG. 2). a period of 90 seconds is indicated. During this malfunction hunt, for example, circulating pump UP and burner motor BM are in operation and a blinking code output produced to display readiness for commencement of a testing procedure (represented in FIG. 5 by the condition "blinking"). If the part of the time sequence diagram of FIG. 5 that is represented in dashed lines is omitted, then the diagram obtained is that for performing the testing of the operational components.

With a connected testing device 1, 1', for example, actuation button 3 of testing device 1 is actuated and, with this first pressing of a button, circulating pump UP is switched on. If no other testing button actuation occurs during, for example, a given waiting time $t_W$, which is assumed to be a maximum of 60 seconds in the diagram according to FIG. 5, then circulating pump UP is switched off and the testing procedure is ended. In contrast to the preceding examples, in the embodiment according to FIG. 5, it is assumed that circulating pump UP is always running also, for example, even during performance of the test of the other operational components. But let it be expressly pointed out that this does not necessarily have to be the case, and circulating pump UP can, like the other operational components still to be explained below, also be switched off after a switched-on period $t_O$ of, for example, 15 seconds.

With another push on actuation button 3, then burner nozzle preheater device DV is switched on for a predetermined switched-on time $t_O$ of, for example, 15 seconds. By suitable other actuations of actuation button 3, ignition spark generator ZG, solenoid valve MV, burner motor BM and finally vehicle blower FG are switched on consecutively, but separately, in each case for a predetermined time $t_O$. After performance of such a testing cycle, the start of the testing procedure, i.e., the blinking code output, is resumed.

If testing device 1' is integrated in heater control device 2', as represented based on the example according to FIG. 4, then individual actuations of actuation button 3 by pushing are eliminated and, in operational testing, a connection is established with a diagnostic line, for example, for serial data transmission, and optionally, a connection can be established by this diagnostic line to a computer-aided external evaluation device, which is not shown in more detail in the drawing.

Of course the invention is not limited to the above preferred embodiments, but numerous changes and modifications are possible, which will be apparent to one skilled in the art as being within the scope of the present invention. In particular, the operational components indicated and to be tested in the embodiments are not all inclusive and the testing process according to the invention may be used to, optionally, actuate still other operational components of a heater, separately in each case and/or in connection with individual, other operational components. Alternatively, a predetermined selection of operational components that are to be actuated can also be made that guarantees a reliable report on a malfunction cause, for example. Here, a so-called representative selection is thus involved.

As the preceding embodiments have shown, the testing device according to the invention can be realized by units of varying complexity, specifically starting with a simple, hand-actuated testing device 1, going to an embodiment integrated in heater control device 2 as well as, optionally, in connection with a computer-aided evaluation for performing a malfunction analysis and/or malfunction diagnosis. Common to all applications is that a test of the operational components can be performed quickly and in particular without removing heater control device Hs or 2, 2' so that the causes of malfunctions of operational components, including those also by defective line connections, can be reliably detected. In particular, testing device 1 or 1' according to the invention can be used universally for all heater types, and in particular further developments of heaters without high development cost can also be taken into consideration.

I claim:

1. Process for testing operational components in heaters of the type including a circulating pump, burner nozzle preheater device, ignition spark generator solenoid valve, burner motor, and a vehicle blower, the process, comprising the steps of individually, sequentially actuating the operational components for operational testing, and evaluating the existence of a component malfunction on the basis of the result of the actuation of the respective individual component.

2. Process according to claim 1, wherein the actuation for operational testing is triggered by pressing a button.

3. Process according to claim 1, wherein the actuation for operational testing is effected by connecting a testing device.

4. Process according to claim 1, wherein component malfunctions found to exist during actuation are identified and displayed.

5. Process according to claim 4, wherein the display is produced by light-emitting diodes.

6. Process according to claim 4, wherein a computer is used for the evaluation, identification and display.

7. Process according to claim 1, wherein the testing procedure is conducted after a readiness-indicating blinking code output is produced.

8. Process according to claim 1, wherein testing of the operational components is initiated automatically.

9. Process according to claim 8, wherein the automatic initiation of testing is performed by a microprocessor control device of the heater.

10. Process according to claim 9, wherein the microprocessor control device performs the evaluating step.

11. Process according to claim 9, wherein, before testing the operational components, a self-test of the control device is performed.

12. Testing device for operational components in heater, of the type including a circulating pump, burner nozzle preheater device, ignition spark generator, solenoid valve, burner motor, and a vehicle, blower, the testing device comprising a switching-on device having means for sequentially actuating each of the operational components of the heater on an individual basis.

13. Testing device according to claim 12, wherein the switching-on device is manually actuatable.

14. Testing device according to claim 13, wherein the switching-on device has an actuation button.

15. Testing device according to claim 13, wherein a blinking code output device is provided as a readiness indicator for actuation of the switching-on device.

16. Testing device according to claim 12, wherein the switching-on device is automatically actuatable.

17. Testing device according to claim 16, wherein evaluation and display means are provided for identifying malfunctions occurring during switching-on the respective components.

18. Testing device according to claim 17, wherein said display means comprises light-emitting diodes or the like.

19. Testing device according to claim 17, wherein the evaluation and display means are externally separate from the heater.

20. Testing device according to claim 16, wherein the switching-on device is built into a control device of the heater.

21. Testing device according to claim 20, wherein an evaluation device is associated with the switching on device in the control device for determining the existence of a component malfunction.

22. Testing device according to claim 20, further comprising a self-test device in said control device, said self-test being activated prior to said switching-on device for testing the operation of the control device.

23. Testing device according to claim 21, wherein said testing device comprises a microprocessor device.

24. Testing device according to claim 23, wherein the microprocessor device forms part of a microprocessor control of the control device of the heater.

* * * * *